US012059064B2

(12) United States Patent
Patrick

(10) Patent No.: US 12,059,064 B2
(45) Date of Patent: Aug. 13, 2024

(54) CURL CREATION, ENHANCEMENT, AND PRESERVATION HAIR CAP

(71) Applicant: Alexia Kay Patrick, Dallas, TX (US)

(72) Inventor: Alexia Kay Patrick, Dallas, TX (US)

( * ) Notice: Subject to any disclaimer, the term of this patent is extended or adjusted under 35 U.S.C. 154(b) by 235 days.

(21) Appl. No.: 17/523,862

(22) Filed: Nov. 10, 2021

(65) Prior Publication Data

US 2023/0142805 A1 May 11, 2023

(51) Int. Cl.
*A45D 2/46* (2006.01)
*A42B 1/04* (2021.01)

(52) U.S. Cl.
CPC . *A45D 2/46* (2013.01); *A42B 1/04* (2013.01)

(58) Field of Classification Search
CPC ... A45D 8/00; A45D 8/36; A45D 8/40; A45D 2/46; A45D 7/00; A45D 19/18; A42B 1/04; A42B 1/049
See application file for complete search history.

(56) References Cited

U.S. PATENT DOCUMENTS

| | | | | |
|---|---|---|---|---|
| 3,298,035 | A | 1/1967 | Gobins | |
| 3,320,682 | A | 5/1967 | Sliman | |
| 5,365,613 | A | 11/1994 | Henegan | |
| 5,411,040 | A | 5/1995 | Forrest | |
| 5,490,528 | A | 2/1996 | Day | |
| 5,920,909 | A | 7/1999 | Ellsworth et al. | |
| 6,560,784 | B2 | 5/2003 | Hill | |
| 9,532,620 | B2 | 1/2017 | McGuire et al. | |
| 10,455,879 | B2 * | 10/2019 | Guice | A42B 1/206 |
| 2004/0094179 | A1 * | 5/2004 | Baldwin | A45D 8/40 132/274 |
| 2007/0084480 | A1 * | 4/2007 | Chudzik | A45D 8/36 132/273 |
| 2015/0272294 | A1 | 10/2015 | Wicker | |
| 2017/0042267 | A1 * | 2/2017 | Guice | A42B 1/12 |
| 2018/0077988 | A1 * | 3/2018 | Thomas | A42B 1/04 |
| 2018/0249804 | A1 * | 9/2018 | Walker | A45D 20/18 |
| 2018/0310694 | A1 * | 11/2018 | Yepremian | A41D 15/04 |
| 2021/0315347 | A1 * | 10/2021 | Fayomi-Olaleye | A45D 8/40 |
| 2022/0330643 | A1 * | 10/2022 | New | A41D 20/00 |

* cited by examiner

*Primary Examiner* — Cris L. Rodriguez
*Assistant Examiner* — Karim Asqiriba
(74) *Attorney, Agent, or Firm* — Kirby Drake

(57) ABSTRACT

A hair cap may create and/or enhance natural hair curls and/or preserves and/or adds hair volume without using, heat, chemicals, or expensive equipment. The hair cap may include a headband attached to a firm inner platform/rim surrounded by an attached cloth which may be formed of microfiber. The cloth may be wrapped around the user's head and then secured using an attachment mechanism to hold curls on top of the user's head with the curls resting on the platform. The top portion of the hair cap or bonnet may be open so that it does not depress down on the user's hair or head. This may allow better overall curl formation and volume. The opening also may facilitate personalized shaping and styling of the hair.

18 Claims, 4 Drawing Sheets

CURL CREATION, ENHANCEMENT, AND PRESERVATION HAIR CAP

FIELD OF THE DISCLOSURE

The present disclosure generally relates to a hair cap, and more particularly to a hair cap that creates and/or enhances curls and/or preserves and/or adds hair volume.

BACKGROUND

Towels and hair microfiber wraps may flatten the natural curls. This may result in less curl volume after hair has been washed and may prohibit the curls' full natural formation. Bonnets may flatten the top of the hair and do not have the holding design to lift the hair to allow curl formation. Further, non-microfiber towels also decrease shine and increase frizz.

SUMMARY

Embodiments of the present disclosure may provide a curl creation and enhancement hair cap comprising: a headband portion; a firm inner platform (or rim) attached to the headband portion; and a cloth attached to and surrounding the firm inner platform, wherein the cloth may be wrapped around a user's head to hold curls on top of the user's head with the curls resting on the firm inner platform. A front of the hair cap may be positioned at a user's forehead and a back of the hair cap may remain at a nape of a user's neck when the curls rest on the firm inner platform. The cloth may be formed of microfiber. The hair cap also may include an open top portion that may facilitate shaping and styling of the curls and does not depress the curls. No heat or chemicals may be used to create and enhance the curls. The platform may be formed of two layers of microfiber with a layer of heavyweight interfacing secured in between the two layers of microfiber. The heavyweight interfacing may support a user's hair when the curls are resting on the firm inner platform. The headband portion may be formed of a flexible material. The hair cap also may include an elastic portion on the platform to enable stretching the hair cap over the user's head. The hair cap may further include a cinch mechanism or a snap mechanism that may secure the elastic portion relative to the headband portion. The hair cap also may include an attachment mechanism that may secure the cloth around the user's head. The attachment mechanism may be integral with the cloth or separate from the cloth. The attachment mechanism may be selected from the group comprising: a drawstring, a scrunchie, and a rubber band. The headband portion may sit under a user's hairline to avoid leaving a dent in the curls.

Further embodiments of the present disclosure may provide a curl creation and enhancement hair cap comprising: a headband portion formed of a flexible material; a firm inner platform attached to the headband portion; an elastic portion on the platform to enable stretching the hair cap over the user's head; and a microfiber cloth attached to and surrounding the firm inner platform, wherein the microfiber cloth may be wrapped around the user's head to hold curls on top of the user's head with the curls resting on the firm inner platform. The hair cap also may include an attachment mechanism that secures the microfiber cloth around the user's head. The hair cap may further include an open top portion that may facilitate shaping and styling of the curls and does not depress the curls. The headband portion may sit under a user's hairline to avoid leaving a dent in the curls.

BRIEF DESCRIPTION OF THE DRAWINGS

For a more complete understanding of this disclosure, reference is now made to the following description, taken in conjunction with the accompanying drawings, in which.

DETAILED DESCRIPTION

Embodiments of the present disclosure may provide a hair cap or bonnet that may create and/or enhance natural hair curls and/or volume without using, heat, chemicals, or expensive equipment. The hair cap may include a headband attached to a firm inner platform or rim surrounded by an attached cloth, which may be formed of microfiber in embodiments of the present disclosure. The cloth may be wrapped around the user's head and then secured using an attachment mechanism to hold curls on top of the user's head with the curls resting on the platform. The top portion of the hair cap or bonnet may be open so that it does not depress down on the user's hair or head. This may allow better overall curl formation and volume. The opening also may facilitate personalized shaping and styling of the hair in embodiments of the present disclosure.

Figure 1:
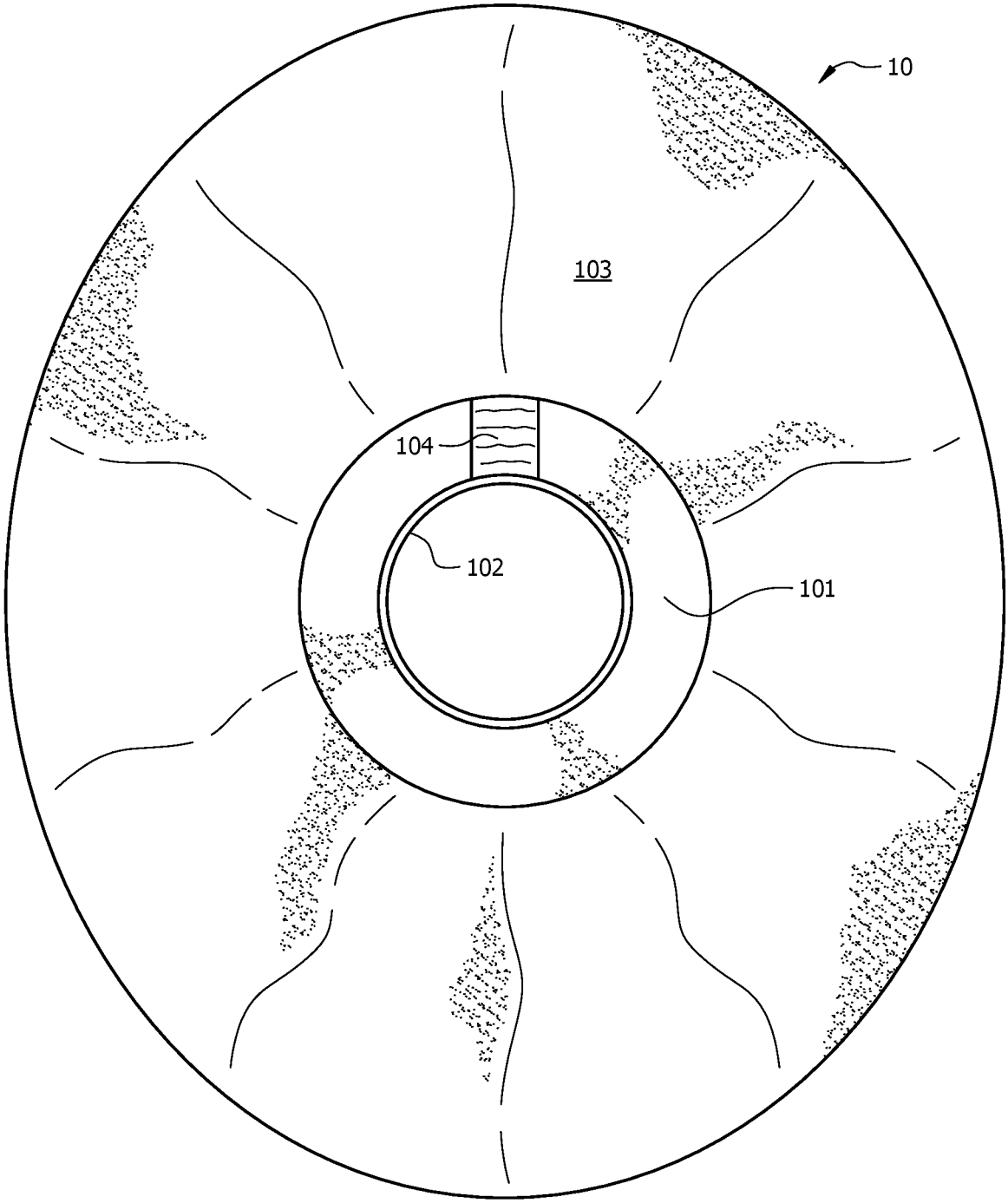
FIG. 1 depicts a hair cap according to an embodiment of the present disclosure.

FIG. 1 depicts hair cap 10 according to an embodiment of the present disclosure. As depicted herein, hair cap 10 may include platform or rim 101, headband 102, and cloth portion 103. In an embodiment of the present disclosure, platform 101 may be formed of two layers of microfiber, with a layer of heavyweight Pellon® interfacing secured in between the layers. It should be appreciated that the two layers of microfiber may be formed of the same type of microfiber; however, there may be other embodiments where different types of microfibers may be used without departing from the present disclosure. Further, there may be other embodiments of the present disclosure where additional or other materials may be used to form platform 101 without departing from the present disclosure. If an interfacing is used as part of platform 101, it should be appreciated that the interfacing should be heavy and firm to support the user's hair when piled on top of platform 101 while not hurting the user's head when in use. Platform or rim 101 also may include elastic portion 104 to enable stretching hair cap 10 over the user's head. Rim/platform 101 may be approximately 2.5-3 inches in width in an embodiment of the present disclosure; however, it should be appreciated that the width of platform 101 may be larger or smaller, such as to accommodate different head sizes, without departing from the present disclosure. In an embodiment of the present disclosure, platform 101 may be approximately 2.5 inches at the forehead and approximately 3 inches at the nape of the user's neck where there may be more hair.

Headband 102 may be formed of a flexible material, which may be elastic. Headband 102 may be approximately 1.5-2 inches in width sitting under the user's hairline in an embodiment of the present disclosure; however, it should be appreciated that the width of headband 102 may be larger or smaller, such as to accommodate different head sizes, without departing from the present disclosure.

Platform 101 may be secured to cloth portion 103 by sewing the materials together in an embodiment of the present disclosure. However, there may be other embodiments of the present disclosure where other attachment mechanisms may be used to secure platform 101 to cloth portion 103, for example, if different materials are used to form platform 101. In an embodiment of the present disclosure, microfibers forming platform 101 may be the same as the microfiber used to form cloth portion 103. However, it should be appreciated that different microfibers may be used for platform 101 and cloth portion 103 without departing from the present disclosure. For example, the densities, blends, and/or weaves may differ between platform 101 and cloth portion 103 in embodiments of the present disclosure.

Platform 101 may have a rounded or ovular shape in some embodiments of the present disclosure. Such a shape may allow platform 101 to remain balanced and in position when placed on top of a user's head. However, other shapes may be utilized for platform 101 without departing from the present disclosure. Hair may rest on platform 101 and not be straightened by gravity, thus facilitating volume and formation of the hair's natural curls while it dries.

Figure 2:
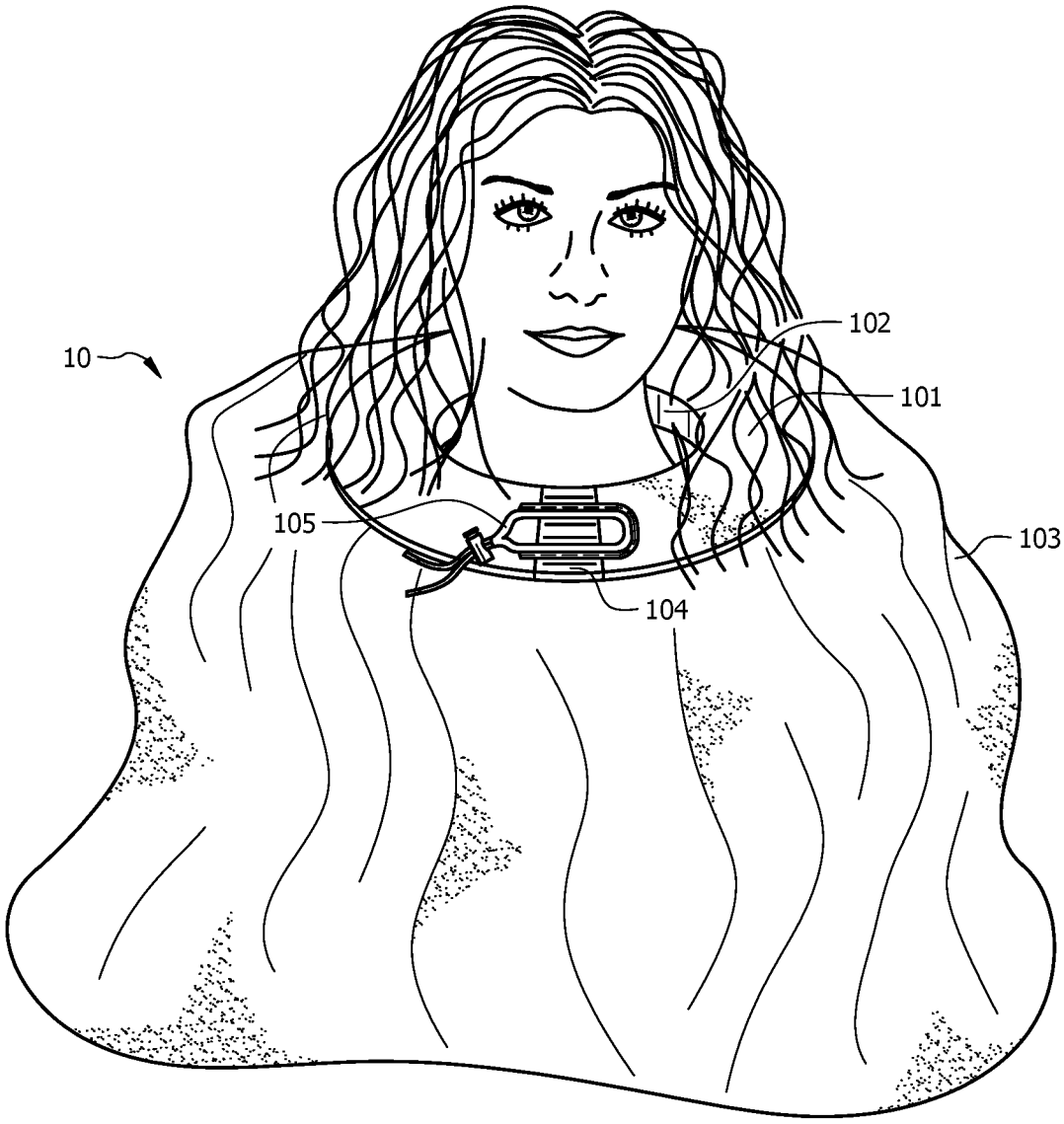
FIG. 2 depicts a user with the hair cap according to an embodiment of the present disclosure before it is engaged with the user's hair.
Figure 5:
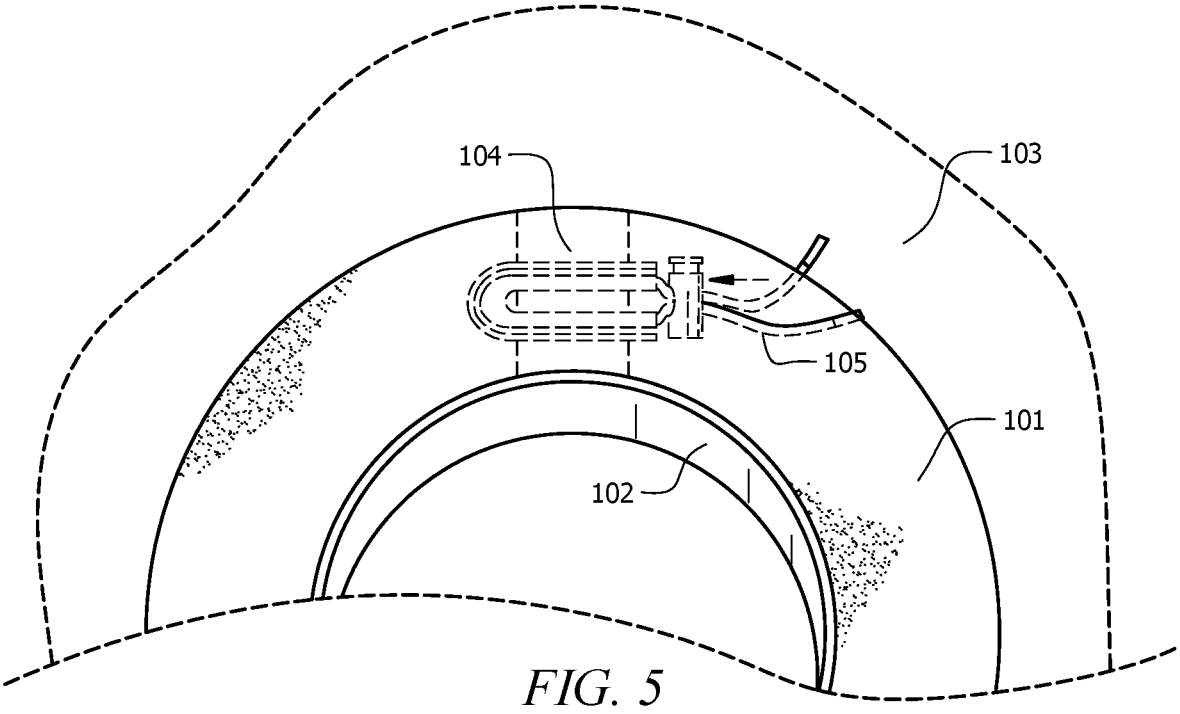
FIG. 5 depicts a top view of an attachment mechanism for the hair cap according to an embodiment of the present disclosure.
Figure 6:
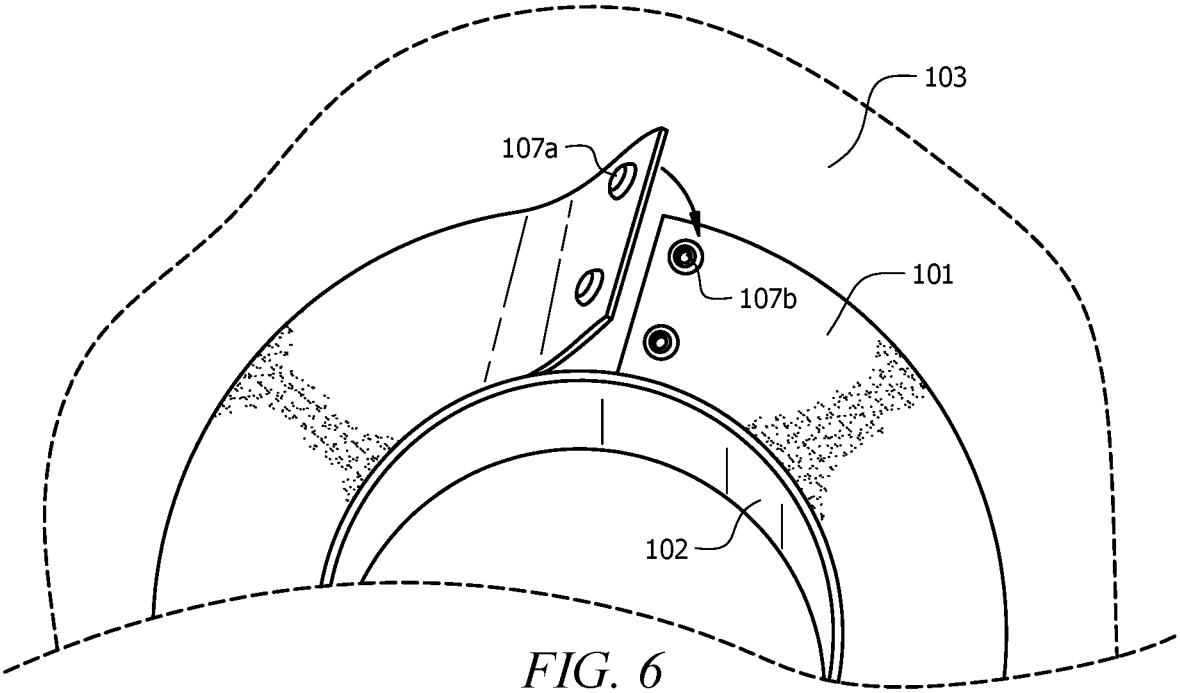
FIG. 6 depicts a top view of an alternative attachment mechanism for the hair cap according to an embodiment of the present disclosure.

FIG. 2 depicts a user with hair cap 10 according to an embodiment of the present disclosure before it is engaged with the user's hair. As depicted herein, platform/rim 101 and headband 102 may encircle the user's neck with cloth portion 103 hanging over the user's shoulders prior to being engaged with the user's hair. Platform 101 and headband 102 may include elastic portion 104 in some embodiments of the present disclosure that may allow hair cap 10 to fit over the user's head with more ease. Elastic portion 104 may include cinch mechanism 105 to secure the position of elastic portion 104 relative to headband 102 in embodiments of the present disclosure. Cinch mechanism 105 in embodiments of the present disclosure may include, but is not limited to, a cinch cord/loop that may be sewn over elastic portion 104 (FIG. 5) or a snap option having snaps 107*a*, 107*b* may be used (FIG. 6). It should be appreciated that cinch mechanism may be a cinch cord/loop placed under platform 101 to prevent hair from getting caught in an embodiment of the present disclosure.

Figure 3:
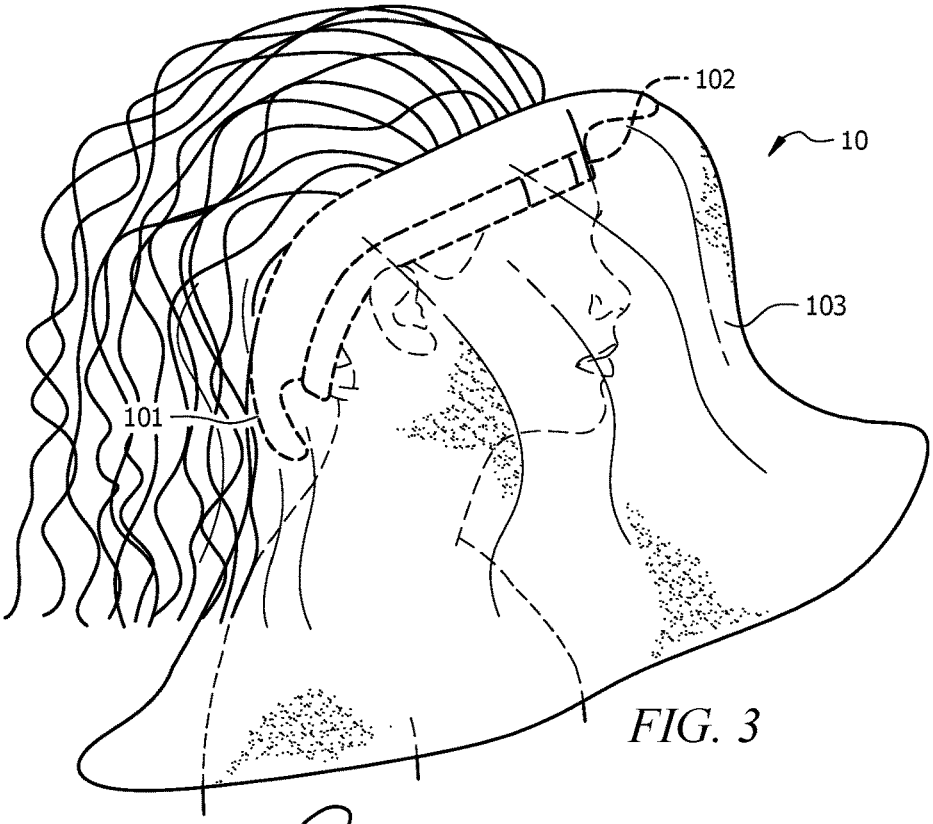
FIG. 3 depicts a hair cap according to an embodiment of the present disclosure as it is being engaged with the user's hair.

FIG. 3 depicts hair cap 10 according to an embodiment of the present disclosure as it is being engaged with the user's hair. Hair cap 10 may be placed over the user's head by lowering past the user's ears. The front of hair cap 10 may be pulled to the user's forehead. The back of hair cap 10 may remain at the nape of the user's neck. Bringing the front of hair cap 10 to the user's forehead may allow all the user's hair to be collected to be placed on platform 101. As depicted herein, platform 101 may sit inside cloth portion 103 when headband 102 is raised to the user's forehead.

Figure 4:
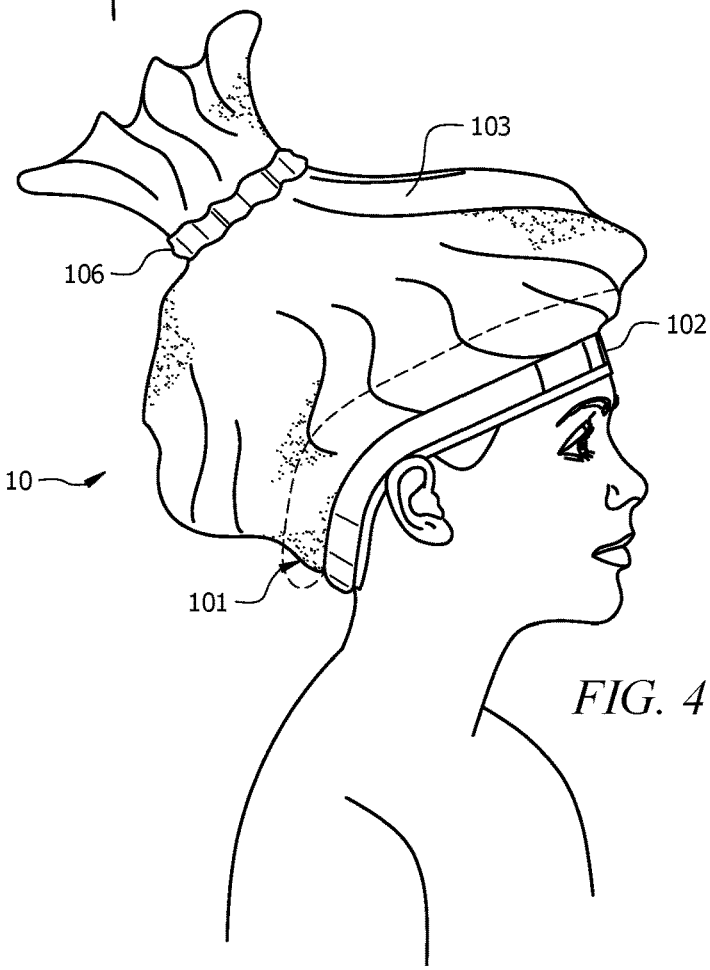
FIG. 4 depicts a hair cap according to an embodiment of the present disclosure when it is engaged with the user's hair.

The user's hair may then be scrunched up to form curls and then cloth portion 103 may be gathered up and over the hair while placing the hair on platform 101 to hold the hair in place. Cloth portion 103 may be secured with attachment mechanism 106 as depicted in FIG. 4 where hair cap 10 has been engaged with the user's hair. It should be appreciated that attachment mechanism 106 may include, but is not limited to, a drawstring, a scrunchie, or rubber band in embodiments of the present disclosure. Regardless of what attachment mechanism 106 is used, attachment mechanism 106 should be formed to hold the flaps of cloth portion 103 in place above the user's head while not weighing down hair cap 10. It should be appreciated that attachment mechanism 106 may be integral with cloth portion 103 or other components of hair cap 10 in some embodiments of the present disclosure; however, attachment mechanism 106 may be a separate component from hair cap 10 without departing from the present disclosure.

Placement and securing of cloth portion 103 as depicted in FIG. 4 around the user's hair may facilitate drying capacity, shine, and reduce hair frizz in embodiments of the present disclosure. Headband 102 may sit under the user's hairline to avoid leaving a dent in the user's curls.

It should be appreciated that the hair cap according to embodiments of the present disclosure may be used after the user's hair has been washed and any curl-enhancement products have been applied to the user's hair. While embodiments of the present disclosure have been described with respect to use with freshly washed hair, it should be appreciated that there may be other embodiments of the present disclosure where a user may employ the hair cap including, but not limited to, wearing while sleeping to maintain curls, wearing to hide use of curlers, and/or wearing to dry hair after swimming or being in the rain or other inclement weather conditions.

It also should be appreciated that the hair cap according to embodiments of the present disclosure may allow users a hands-free application of make-up and facial skin treatments that can be done under a variety of needs including, but not limited to, while the hair is drying from a shower or anytime such applications are desired. Such applications may be applied to the user's face, neck, and/or back areas without concern such applications will touch the user's hair or mix with the applications on the hair. The hair cap according to embodiments of the present disclosure may be put on immediately after a stylist or salon treatment of a user's hair to preserve and/or protect the "fresh from the salon" styling until the user removes the hair cap. The hair cap according to embodiments of the present disclosure may protect the user's hair in general and/or protect and preserve the structural integrity of the hair curls by wearing when the hair is exposed to the natural elements of nature from getting excessively dried, frizzy, dusty/dirty, exposed to rain/snow, and/or directly exposed to excessive cold/heat in the environment. This may be helpful for important social events, meetings, job interviews, and/or for general protection and preservation in embodiments of the present disclosure. The hair cap according to embodiments of the present disclosure may be used for hands-free changing of clothing, such as wedding dresses, blouses, and/or dresses, and preserving the user's hair style and/or curls. The hair cap may protect the user's hair and provide a barrier from touching the user's clothing. The hair cap according to embodiments of the present disclosure may be worn, for example, when driving a vehicle to avoid excessive pressing or crimping of the hair for all hair types to be maintained. The hair cap according to embodiments of the present disclosure may be worn during low impact or light exercise (e.g., yoga, weight training, jogging) to avoid sweat or heat odors from encountering the user's hair to preserve the style. The hair cap according to embodiments of the present disclosure may be worn while cooking or other activities to help protect the hair from odors, fumes, grease, and other smells, thereby minimizing the unpleasantness.

It should be appreciated that the hair cap according to embodiments of the present disclosure may come in a variety of colors, styles, and/or materials. The hair cap according to embodiments of the present disclosure can be mixed and matched with other clothes to serve as a formal wear centerpiece or casual seasonal wear for warmth and comfort with style.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A curl creation and enhancement hair cap comprising:

a headband portion;

a firm inner platform attached to the headband portion, the firm inner platform formed of two layers of microfiber with a layer of heavyweight interfacing secured in between the two layers of microfiber, wherein the heavyweight interfacing supports a user's hair when the curls are resting on the firm inner platform; and a cloth attached to and surrounding the firm inner platform, the cloth having flaps wherein the cloth is wrapped around a user's head to hold curls on top of the user's head with the curls resting on the firm inner platform, wherein the user's hair rests on the firm inner platform and is not straightened by gravity, thereby facilitating volume and formation of the curls while the user's hair dries.

2. The curl creation and enhancement hair cap of claim 1, wherein a front of the hair cap is positioned at a user's forehead and a back of the hair cap remains at a nape of a user's neck when the curls rest on the firm inner platform.

3. The curl creation and enhancement hair cap of claim 1, wherein the cloth is formed of microfiber.

4. The curl creation and enhancement hair cap of claim 1, further comprising:

an open top portion that facilitates shaping and styling of the curls and does not depress the curls.

5. The curl creation and enhancement hair cap of claim 1, wherein no heat or chemicals are used to create and enhance the curls.

6. The curl creation and enhancement hair cap of claim 1, wherein the headband portion is formed of a flexible material.

7. The curl creation and enhancement hair cap of claim 1, further comprising:

an elastic portion on the firm inner platform to enable stretching the hair cap over the user's head.

8. The curl creation and enhancement hair cap of claim 7, further comprising:

a cinch mechanism that shortens or lengths the firm inner platform and secures the elastic portion relative to the headband portion.

9. The curl creation and enhancement hair cap of claim 7, further comprising:

a snap mechanism that secures the elastic portion relative to the headband portion.

10. The curl creation and enhancement hair cap of claim 1, further comprising:

an attachment mechanism that holds the flaps in place above the user's head and secures the cloth around the user's head.

11. The curl creation and enhancement hair cap of claim 10, wherein the attachment mechanism is integral with the cloth.

12. The curl creation and enhancement hair cap of claim 10, wherein the attachment mechanism is separate from the cloth.

13. The curl creation and enhancement hair cap of claim 10, the attachment mechanism selected from the group comprising:

a drawstring, a scrunchie, and a rubber band.

14. The curl creation and enhancement hair cap of claim 1, wherein the headband portion sits under a user's hairline to avoid leaving a dent in the curls.

15. A curl creation and enhancement hair cap comprising:

a headband portion formed of a flexible material;

a firm inner platform attached to the headband portion;

an elastic portion on the firm inner platform to enable stretching the hair cap over the user's head; and a microfiber cloth attached to and surrounding the firm inner platform, the microfiber cloth having flaps wherein the microfiber cloth is wrapped around the user's head to hold curls on top of the user's head with the curls resting on the firm inner platform.

16. The curl creation and enhancement hair cap of claim 15, further comprising:

an attachment mechanism that holds the flaps in place above the user's head and secures the microfiber cloth around the user's head.

17. The curl creation and enhancement hair cap of claim 15, further comprising:

an open top portion that facilitates shaping and styling of the curls and does not depress the curls.

18. The curl creation and enhancement hair cap of claim 15, wherein the headband portion sits under a user's hairline to avoid leaving a dent in the curls.

* * * * *